United States Patent [19]

Hengelhaupt

[11] 4,131,372

[45] Dec. 26, 1978

[54] ENDLESS FABRIC RIBBON CASSETTE FOR TYPEWRITERS OR LIKE MACHINES

[75] Inventor: Hans Hengelhaupt, Nuremberg, Fed. Rep. of Germany

[73] Assignee: Triumph Werke Nurnberg A.G., Nuremberg, Fed. Rep. of Germany

[21] Appl. No.: 789,966

[22] Filed: Apr. 22, 1977

[30] Foreign Application Priority Data

Apr. 27, 1976 [DE] Fed. Rep. of Germany ..... 2618379

[51] Int. Cl.[2] ..... B41J 33/10

[52] U.S. Cl. ..... 400/196.1; 400/227

[58] Field of Search ..... 197/151, 168; 400/194, 400/195, 196, 196.1, 207, 208, 227

[56] References Cited

U.S. PATENT DOCUMENTS

| | | | |
|---|---|---|---|
| 3,604,549 | 9/1971 | Caudill et al. | 197/151 |
| 3,904,017 | 9/1975 | Frechette | 197/168 X |
| 3,974,906 | 8/1976 | Lee et al. | 197/168 |
| 3,994,383 | 11/1976 | Best | 197/168 |

*Primary Examiner*—Paul T. Sewell

*Attorney, Agent, or Firm*—Joseph R. Spalla

[57] ABSTRACT

A fabric ribbon cassette wherein an endless folded fabric ribbon is drawn across the printing point of a typewriter or like machine by feed gears which are couplable to and driven by machine mounted feed gears which are also designed to feed cassette supported single pass or multistrike carbon ribbons.

4 Claims, 4 Drawing Figures

ENDLESS FABRIC RIBBON CASSETTE FOR TYPEWRITERS OR LIKE MACHINES

This invention relates to spoolless ribbon cassettes for typewriters or like machines; more particularly, it relates to a spoolless ribbon cassette containing randomly folded endless fabric ribbon, and meshing gears for moving said ribbon past a printing point, and specifically to a spoolless ribbon cassette wherein the meshing gears are couplable to ribbon feed mechanism designed to feed single or multiple strike single pass carbon ribbons.

In accordance with German Patent No. 1,611,454 (corresponding to U.S. Pat. Nos. 3,604,549 and 3,731,781) ribbon cassettes containing single pass carbon ribbons of the single strike or multiple strike type are disclosed in association with unidirectional feed mechanism which is conditioned to provide the proper feed increment according to the type of single pass carbon ribbon cassette mounted thereon.

A machine with a different and reversible ribbon feed mechanism must be provided for use with fabric ribbon cassettes wherein the fabric ribbon is wound on reversible spools whose feed direction must be repeatedly reversed.

In accordance with the invention, a ribbon cassette containing an endless fabric ribbon and ribbon feed gears is designed to be coupled to and driven by a unidirectional feed mechanism such as that in German Patent No. 1,611,454 designed for single pass carbon ribbons thus avoiding the necessity for reversible fabric ribbon feed mechanisms.

An object of the invention is in the provision of an endless fabric ribbon cassette which can be accommodated, and the ribbon therein fed, by a unidirectional carbon ribbon transport mechanism.

Other objects, features and advantages of the present invention will become better understood by those skilled in the art from a reading of the following detailled description of a preferred embodiment when taken in conjunction with the accompanying drawing wherein like reference numerals designate like or corresponding parts throughout the several views thereof and wherein.

Figure 1:
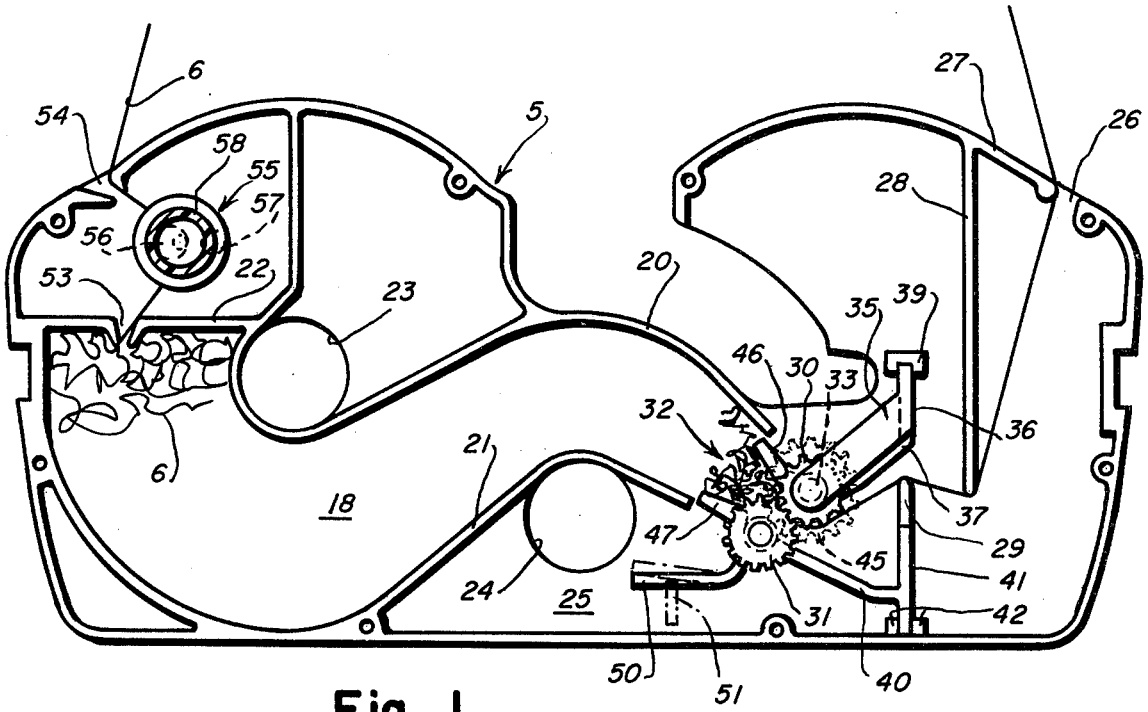
FIG. 1 is a top elevational view with cover removed of an endless fabric ribbon cassette.
Figure 2:
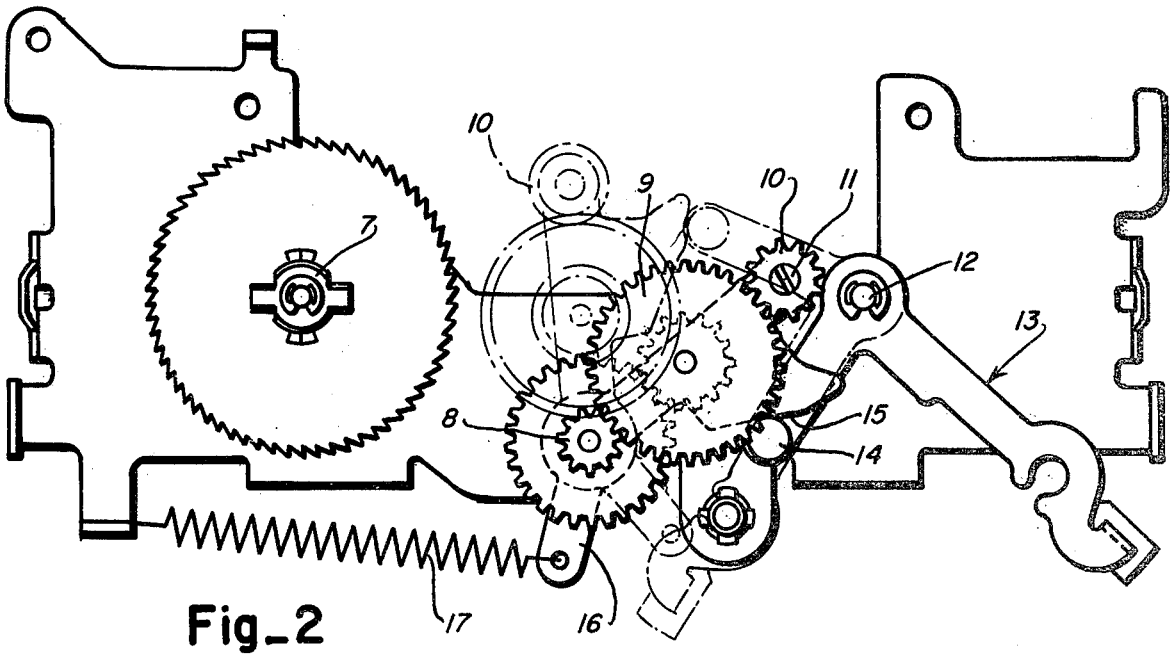
FIG. 2 is a top elevational view of a unidirectional carbon ribbon transport mechanism.
Figure 3:
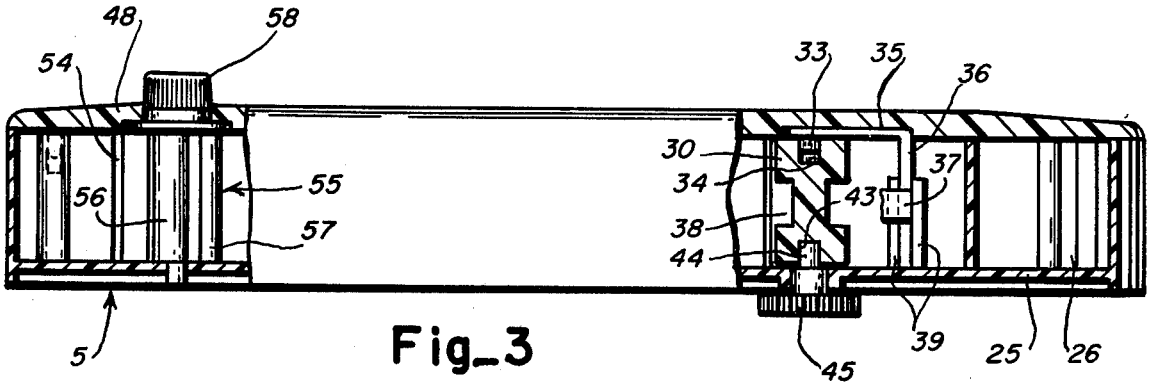
FIG. 3 is a side elevational view of the cassette shown in FIG. 1 with sections cut away.
Figure 4:
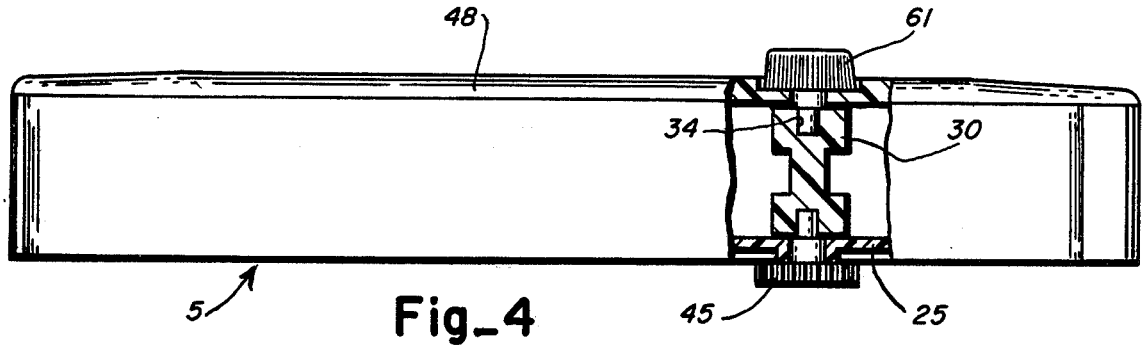
FIG. 4 is a side elevational view similar to FIG. 3 of another embodiment.

Referring now to the drawing wherein like or corresponding parts are designated by the same reference numerals, there is shown in FIGS. 1, 3, and 4 a cassette generally designated by reference numeral 5 designed to accommodate a folded endless fabric ribbon 6. The cassette 5 has the same dimensions and essentially the same shape and size as the cassettes shown in German Patent No. 1,611,454 for accommodation to a transporting mechanism substantially as shown therein, parts of which are shown in FIG. 2 herein. More particularly, as shown in FIG. 2, the carbon ribbon transporting mechanism comprises a support post 7 for a full carbon ribbon supply spool, a drive pinion 8, an intermediate transport gear 9 and a carbon ribbon transport gear 10 having a spoked post 11 for driving engagement with ribbon wound on a carbon ribbon take-up spool mounted on post 12. The transport mechanism also includes an inverted V-shaped cassette loading lever 13, pivoted on post 12 and having a camming pin 14 on one arm adapted to engage a cam edge 15 of a lever 16 which supports at one end the carbon ribbon transport gear 10. Lever 16 is biased by a spring 17 to maintain the spoked post 11 in engagement with the outer coil of carbon ribbon wound on a carbon ribbon take-up spool while allowing outward movement of lever 16 as the diameter of wound carbon ribbon increases. Movement of the loading lever 13 from full line to dotted line position permits loading of a cassette.

With reference again to FIG. 1, there is provided inside the endless ribbon cassette 5 a chamber 18 in which the endless ribbon 6 is stored in randomly folded form. The chamber 18 is defined by support webs 20, 21 and 22, increases in width from right to left, and is curved to accommodate movement of the spoked post 11 of the carbon ribbon transport and around openings 23 and 24 in the bottom wall 25 of the cassette to accommodate the carbon ribbon supply support post 7 and drive gear 8. The fabric ribbon 6 is pulled into the cassette 5 through an entry opening 26 in the cassette side wall 27. Before the ribbon 6 enters the chamber 18 it is stabilized by spaced guide webs 28, 29 in zig-zag arrangement so that it cannot run obliquely into meshing knurled drive and driven feed rollers 30, 31 located at the inlet end 32 to the chamber 18 to draw ribbon into the chamber 18 in folded form. The knurled drive roller 30 is pivotally mounted as by a pin 33 extending into a counterbore 34 of roller 30. The pin is formed on the upper arm 35 of a holder 36 of resilient plastic which also includes an intermediate arm 37 formed to embrace an annular recess 38 in roller 30. The holder 36 is secured between lugs 39 formed internally in the cassette 5.

Similarly, the driven roller 31 which has a floating axis is rotatably supported by a flexible lateral arm 40 which is formed to embrace an intermediate annular recess of roller 31 and is flexed to bias the driven roller 31 toward drive roller 30. The lateral arm 40 is part of a holder 41 secured between lugs 42 formed in the cassette 5.

With reference to FIG. 3, the lower end of roller 30 also has a counterbore 43 into which is press-fitted the shaft 44 of an external gear 45 which shaft extends through the bottom wall 25 of the cassette 5. Gear 45 is adapted to mesh with gear 9 of the ribbon transport mechanism when the fabric ribbon cassette 5 is loaded thereon.

As shown in FIG. 1, the lateral arms 37 and 40 extend into the inlet end 32 of the chamber 18 and constitute stripping fingers 46 and 47 to prevent ribbon fed into the chamber from winding about the feed rollers 30 and 31.

With the removable cassette cover 48 removed, the drive and driven rollers 30, 31 lie loosely in their mountings so that a new fabric ribbon 6, for instance, can readily be inserted between them after an old used ribbon has been removed. The pressure required between rollers 30 and 31 to feed ribbon is generated by means of an arm 50 formed on the flexible arm 40 which pushes the floating driven feed roller 31 peripherally against the driving feed roller 30. Upon replacing the cassette cover 48, pressure upon the arm 50 is exerted thereon by a beveled web 51 whose bevelled edge acts upon the arm 50, flexing it as shown in FIG. 1 by dashed lines.

On the outlet side of the chamber 18 there is provided in the web 22 an outlet opening 53 by which the ribbon 6, before leaving the cassette 5 through the exit opening 54 of the cassette 5, is conducted over a ribbon tightening device generally designated by reference 55 which is pivotally mounted in the cover 48 and bottom wall 25 of the cassette 5, and which can be rotated in either direction. The tightening device 55 consists of two spaced pins 56, 57 between which the ribbon 6 passes and is actuated by means of a knurled knob 58 protruding out of the cassette cover 48. When turning the tightening device 55, the ribbon 6 winds itself on the two pins 56 and 57 and is incrementally unwound from them during the operation of the typewriter. It is only thereafter that the rest of ribbon 6 is pulled out of the chamber 18 through the outlet opening 53.

Another alternative way of tensioning the ribbon 6 is shown in FIG. 4 in which the driving feed roller 30 is provided with a knurled knob 61 press-fitted into counterbore 34 and protruding through the cassette cover 48. Excess ribbon 6 pulled out can be drawn back into the cassette 5 by turning the knob and transport roller 30 in one direction only and only before mounting the fabric ribbon cassette.

The invention claimed is:

1. In combination with a unidirectional ribbon transport mechanism having a train of gears, the last gear on said train of gears serving to wind up a carbon ribbon in a carbon ribbon cassette, a fabric ribbon cassette having a bottom wall, side walls and a removable cover, exit and entry openings in the side walls of said cassette, a chamber having inlet and outlet openings in said cassette, an endless fabric ribbon randomly folded in said chamber and extending therefrom externally of said cassette between said exit and entry openings, a drive and driven feed roller, means supporting said drive and driven rollers for rotation in said cassette at the inlet end of said chamber whereby rotation of said feed rollers pulls ribbon from the outlet side of said chamber and from said exit to said entry openings and folds ribbon into the entry side of said chamber, said means supporting said driven feed roller comprising a flexible arm mounted in said cassette which in unflexed state holds the driven roller in loose engagement with the drive roller means acting on said flexible arm to flex said arm and to bias said driven feed roller into meshing engagement with said drive roller upon assembly of the cassette cover to the cassette, and an external gear secured to said drive roller for driving engagement with an intermediate one of the gears in said train of carbon ribbon feed gears when said fabric ribbon cassette is loaded on said transport mechanism.

2. The combination recited in claim 1, said cassette having a removable cover, said acting means comprising a camming abutment on said cassette cover.

3. The combination as recited in claim 1, means for taking up slack in ribbon extending externally of said cassette between said exit and entry openings, said means being located between said chamber outlet and said cassette exit opening.

4. The combination as recited in claim 3, said take-up means comprising a pair of spaced pins between which said ribbon passes, and means supporting said pins for turning movement as a unit including a knob extending externally of said cassette.

* * * * *